US006822617B1

(12) United States Patent
Mather et al.

(10) Patent No.: US 6,822,617 B1
(45) Date of Patent: Nov. 23, 2004

(54) CONSTRUCTION APPROACH FOR AN EMXT-BASED PHASED ARRAY ANTENNA

(75) Inventors: John C. Mather, Cedar Rapids, IA (US); Christina M. Conway, Cedar Rapids, IA (US); James B. West, Cedar Rapids, IA (US); Gary E Lehtola, Alburnett, IA (US); Joel M. Wichgers, Cedar Rapids, IA (US)

(73) Assignee: Rockwell Collins, Cedar Rapids, IA (US)

( * ) Notice: Subject to any disclaimer, the term of this patent is extended or adjusted under 35 U.S.C. 154(b) by 85 days.

(21) Appl. No.: 10/273,872

(22) Filed: Oct. 18, 2002

(51) Int. Cl.[7] ..... H01Q 21/26
(52) U.S. Cl. ..... 343/797; 343/853
(58) Field of Search ..... 343/797, 841, 343/853, 700 MS, 770; 342/374, 375

(56) References Cited

U.S. PATENT DOCUMENTS

| | | | | | |
|---|---|---|---|---|---|
| 5,170,140 | A | | 12/1992 | Lowe et al. | 333/238 |
| 5,309,165 | A | * | 5/1994 | Segal et al. | 343/770 |
| 5,309,166 | A | | 5/1994 | Collier et al. | 343/778 |
| 5,426,403 | A | | 6/1995 | LaLau et al. | 333/157 |
| 5,786,792 | A | * | 7/1998 | Bellus et al. | 343/770 |
| 5,845,391 | A | * | 12/1998 | Bellus et al. | 29/600 |
| 6,552,691 | B2 | * | 4/2003 | Mohuchy et al. | 343/770 |
| 6,650,291 | B1 | * | 11/2003 | West et al. | 342/371 |

OTHER PUBLICATIONS

Patent Application for "A Method and Structure for Phased Array Antenna Interconnect", by John C. Mather et al. Attorney Docket No. 02CR249/KE.

"Wideband Vivaldi Arrays for Large Aperture Antennas", by Daniel H. Schaubert et al. from Perspectives on Radio Astronomy—Technology for Large Antenna Arrays, Netherlands Foundation for Research in Astronomy, 1999.

"Characteristics of Ka Band Waveguide Using Electromagnetic Crystal Sidewalls", by J. A. Higgins et al., 2002 IEEE MTT–S International Microwave Symposium, Seattle, WA, Jun. 2002.

* cited by examiner

*Primary Examiner*—Tan Ho
(74) *Attorney, Agent, or Firm*—Nathan O. Jensen; Kyle Eppele

(57) ABSTRACT

A phased array antenna with an egg crate array structure is formed from metallic row slats that form a floor and ceiling of each array element. Column slats with slots engage the row slots to form the egg crate array structure. EMXT devices are located on the column slats such that a pair of EMXT devices form array element walls. The column slats are formed from U-shaped column strips configured such that a left side of the U-shape forms a left-hand side of each array element in a column and a right side of the U forms an opposing right-hand side. The column strips sides are mounted back-to-back with sides of adjacent column strips to form the column slats. Circuit devices for operation of the antenna are mounted on the U-shaped column strip and a connector is mounted at an apex of the U-shaped column slat.

19 Claims, 11 Drawing Sheets

CONSTRUCTION APPROACH FOR AN EMXT-BASED PHASED ARRAY ANTENNA

GOVERNMENT RIGHTS

This invention was made under Government contract No. CAAD19-01-9-001 awarded by DARPA. The Government may have certain rights in the invention.

CROSS REFERENCE TO RELATED APPLICATIONS

The present application is related to co-filed application Ser. No. 10/273,459 filed on an even date herewith entitled "A Method and Structure for Phased Array Antenna Interconnect" invented by John C. Mather, Christina M. Conway, and James B. West. The co-filed application is incorporated by reference herein in its entirety. All applications are assigned to the assignee of the present application.

BACKGROUND OF THE INVENTION

This invention relates to antennas, phased array antennas, and specifically to a construction approach for a phased array antenna.

Phased array antennas offer significant system level performance enhancement for advanced communications, data link, radar, and SATCOM systems. The ability to rapidly scan the radiation pattern of the array allows the realization of multi-mode operation, LPI/LPD (low probability of intercept and detection), and A/J (antijam) capabilities. One of the major challenges in phased array design is to provide a cost effective and environmentally robust interconnect and construction scheme for the phased array assembly.

It is well known within the art that the operation of a phased array is approximated to the first order as the product of the array factor and the radiation element pattern as shown in Equation 1 for a linear array 10 of FIG. 1.

$$E_A(\theta) \equiv \underbrace{E_p(\theta,\phi)}_{\substack{\text{Radinition}\\ \text{Element}\\ \text{Pattern}}} \underbrace{\left[\frac{\exp\left(-j\frac{2\pi_0}{\lambda}\right)}{r_o}\right]}_{\substack{\text{Isotropic}\\ \text{Element}\\ \text{Pattern}}} \cdot \underbrace{\sum_N A_n \exp\left[-j\frac{2\pi}{\lambda} n\Delta x(\sin\theta - \sin\theta_0)\right]}_{\text{Array Factor}} \qquad \text{Equation 1}$$

Standard spherical coordinates are used in Equation 1 and θ is the scan angle referenced to bore sight of the array 10. Introducing phase shift at all radiating elements 15 within the array 10 changes the argument of the array factor exponential term in Equation 1, which in turns steers the main beam from its nominal position. Phase shifters are RF devices or circuits that provide the required variation in electrical phase. Array element spacing, Δx or Δy of FIG. 1, is related to the operating wavelength and it sets the scan performance of the array 10. All radiating element patterns are assumed to be identical for the ideal case where mutual coupling between elements does not exist. The array factor describes the performance of an array 10 of isotropic radiators 15 arranged in a prescribed grid as shown in FIG. 1 for a two-dimensional rectangular array grid 10.

To prevent beam squinting as a function of frequency, broadband phased arrays utilize true time delay (TTD) devices rather than phase shifters to steer the antenna beam. Expressions similar to Equation 1 for the TTD beam steering case are readily available in the literature.

The isotropic radiation element 15 in FIG. 1 has infinitesimal dimensions, as explained in subsequent paragraphs. The spacing of the isotropic radiators 15 determines the scan performance of the phased array 10. The elements 15 must be spaced less than or equal to one half wavelength ($\lambda_o/2$) apart for the radiated pattern to be free from grating lobes. Grating lobes are false undesired beams having strength equal to the main beam. The wider the element spacing, Δx or Δy, the smaller the grating lobe-free scan volume is for the array 10. Array factors are also available for 2-D and 3-D phased arrays having rectangular and hexagonal grid arrangements, but they are not discussed here for the sake of brevity.

The isotropic radiating element 15 is an infinitesimally small, nonphysical mathematical concept that is useful for array analysis purposes. However, all operational arrays utilize physical radiating elements 25 of finite size as shown in the array 20 of FIG. 2. Radiating element size in the plane of a planar array, or along the array surface for a conformal array, is usually a large fraction of $\lambda_o/2$, as required for efficient radiation. Since the array spacing, Δx or Δy, sets the grating lobe-free scan volume of the array 20, it also puts restrictions on the transverse size of the individual radiating elements 25 within the array 20. The extremities of neighboring radiating elements 25 are frequently very close to one another and in some cases, the array spacing, Δx or Δy, prevents certain types of radiating elements 25 from being used.

A comparison of FIGS. 1 and 2 illustrates how real, physical radiating elements 25 consume the majority of the surface area around the array grid intersection points. The array element spacing, Δx or Δy, and transverse size restrictions are further exacerbated in electronically scanned phased arrays. The most general two-dimensional, or three-dimensional (arbitrarily curved surface) electrically scanned phased array antennas require phase shifters at each radiating element 25 to electronically scan the main beam of the radiation pattern. A very space-efficient interconnect cable assembly is required to provide the proper control signals, bias and chassis ground to each individual radiating element 25 and the phase shifters (not shown). However, the physical size of the cabling assembly is often too large and cumbersome to effectively route around the array radiating elements 25 without perturbing the RF field of the radiating element 25 and/or the aggregate field of the sub-array or top-level array assemblies.

The referenced application effectively resolves the phased array interconnect problem by utilizing fine pitch, high-density circuitry in a thin self-shielding multi-layer printed wiring assembly. The new approach utilizes the thickness dimension of an array aperture wall (parallel to bore sight axis) to provide the surface area and volume required to implement all of the conductive traces for phase shifter bias, ground, and control lines. The thickness of the printed wiring assemblies 35 are now in the x-y plane (front view) of the radiating elements 25 in the phased array 30 as shown in FIG. 3.

A packaging, interconnect, and construction approach is needed to create a cost-effective EMXT (electromagnetic crystal)-based phased array antennas having multiple active radiating elements in an X-by-Y configuration. EMXT devices are also known in the art as tunable photonic band gap (PBG) and tunable electromagnetic band gap (EBG) substrates. A detailed description of a waveguide section with tunable EBG phase shifter technologies is available in a paper by J. A. Higgins et al. "Characteristics of Ka Band Waveguide using Electromagnetic Crystal Sidewalls" 2002

IEEE MTT-S International Microwave Symposium, Seattle, Wash., June 2002. Each element is comprised of EMXT sidewalls and a conductive (metallic) floor and ceiling. Each EMXT device requires a bias voltage plus a ground connection in order to control the phase shift for each element of the antenna by modulating the sidewall impedance of the waveguide. By controlling phase shift performance of the elements, the beam of the antenna can be formed and steered. The maximum permitted distance between centerlines of adjacent apertures is $\lambda_o/2$ in both the X and Y directions and the total thickness of the EMXT plus mounting structure and interconnect must be minimized.

A design approach is needed that utilizes the interconnect scheme disclosed in the referenced application to construct a phased array antenna that can be assembled into a configuration with multiple radiating elements.

SUMMARY OF THE INVENTION

A phased array antenna for steering a radiated beam and having an egg crate-like array structure of array elements is disclosed. The phased array antenna is constructed from row slats formed from a metallic substrate. The row slats have a plurality of row slots. Column slats with a plurality of column slots that engage the row slots on the row slats to form the egg crate-like array structure. The column slats are formed from column strips that are configured in a U-shape. Each column strip is configured such that a left side of the U-shape forms a left-hand side of each array element in a column and a right side of the U forms an opposing right-hand side of each array element. Column strip sides are mounted back-to-back with sides of adjacent column strips to form the column slats. The column strip left-hand side is a mirror image of the right-hand side.

The U-shape column strip includes interconnect circuitry and EMXT devices mounted on the U-shape column strip and connected to the interconnect circuitry for shifting phase to steer the radiated beam of the EMXT-based phased array antenna. The EMXT devices mounted to the column strip form left and right sidewalls of each array element. Circuit devices for operation of the phased array antenna are mounted to the U-shaped column strip. A connector is mounted at an apex of the U-shaped column slat.

It is an object of the present invention to create a cost effective improved interconnect and construction approach for an EMXT-based phased array antenna.

It is an object of the present invention to create a phased array antenna capable of having hundreds or thousands of array elements easily fabricated and interconnected either through sub array or direct array construction techniques.

It is an advantage of the present invention to incorporate a fine pitch, high density interconnect scheme to interconnect EMXT phase shifting devices.

It is a feature of the present invention to provide an enhanced construction technique that allows simplified mounting of circuit components to control the phased array antenna.

BRIEF DESCRIPTION OF THE DRAWINGS

The invention may be more fully understood by reading the following description of the preferred embodiments of the invention in conjunction with the appended drawings wherein.

DETAILED DESCRIPTION

Figure 1:
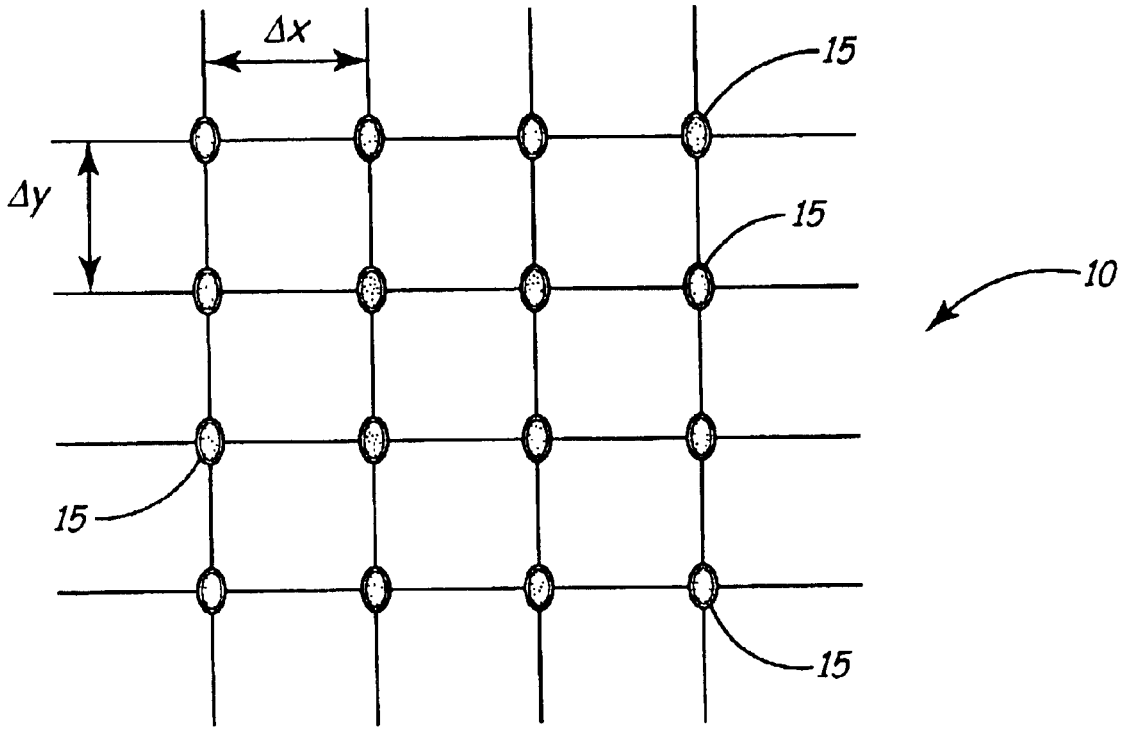
FIG. 1 is a diagram of a rectangular 2-D planar phased array isotropic element grid.
Figure 2:
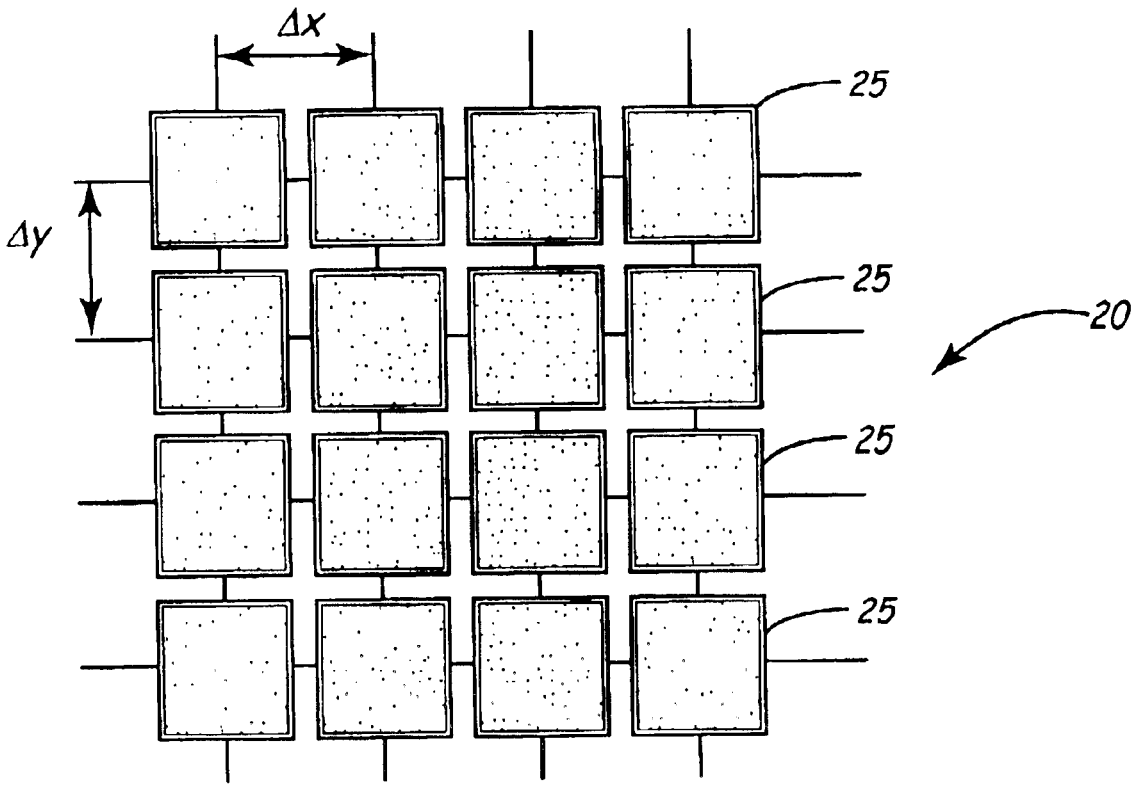
FIG. 2 is a diagram of a rectangular 2-D planar phased array physical radiating element grid.
Figure 3:
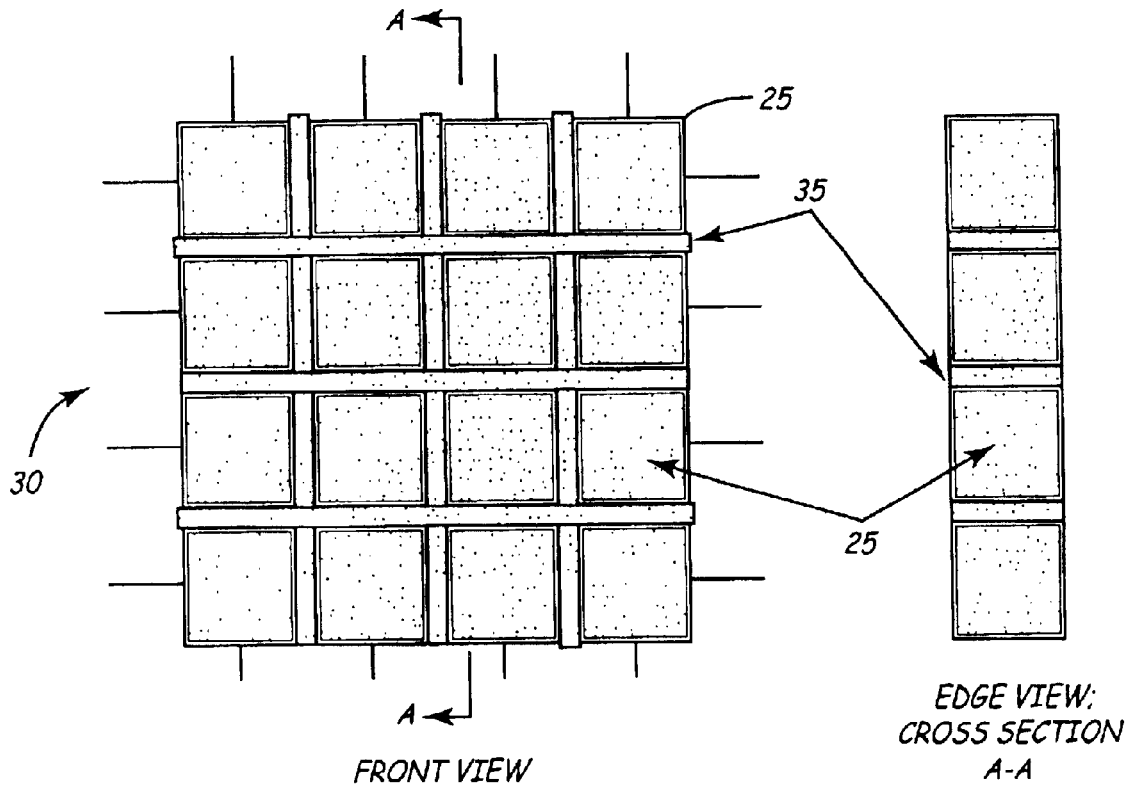
FIG. 3 is a diagram of a rectangular 2-D planar phased array interconnect scheme.

The referenced application presents a novel design approach for phased array antenna interconnects and includes a discussion of a 38-GHz application as a specific example. The reference describes a phased array interconnect that utilizes a fine pitch, high-density circuitry in a thin self-shielding multi-layer printed wiring assembly. The new approach utilizes the thickness dimension of an array aperture wall (parallel to bore sight axis) to provide the surface area and volume required to implement all of the conductive traces for phase shifter bias, ground, and control lines. The thickness of the printed wiring assemblies 35 are now in the x-y plane (front view) of the radiating elements 25 in the phased array 30 as shown in FIG. 3.

The present invention extends and adapts that interconnect design approach such that the substrate used in the construction of the interconnect circuitry is configured to become the structure of a waveguide lens array for an EMXT (electromagnetic crystal)-based phased array antenna. The same 38-GHz phased array antenna is again used as a specific example herein.

Note that although a space feed is shown in the following discussion other feed arrangements are applicable to the present invention. These include such feeds as a semi-constrained waveguide feed (e.g. pill box waveguide feed) and constrained feeds such as waveguide, stripline, microstrip, and coplanar waveguide feeds.

The referenced application discloses a circuitized column slat approach for achieving reliable EMXT device 61 mounting and providing for an electrically shielded interconnect as described below and illustrated in FIG. 4. The column slat 80 forms the walls of an array 50 in FIG. 5.

Figure 4:
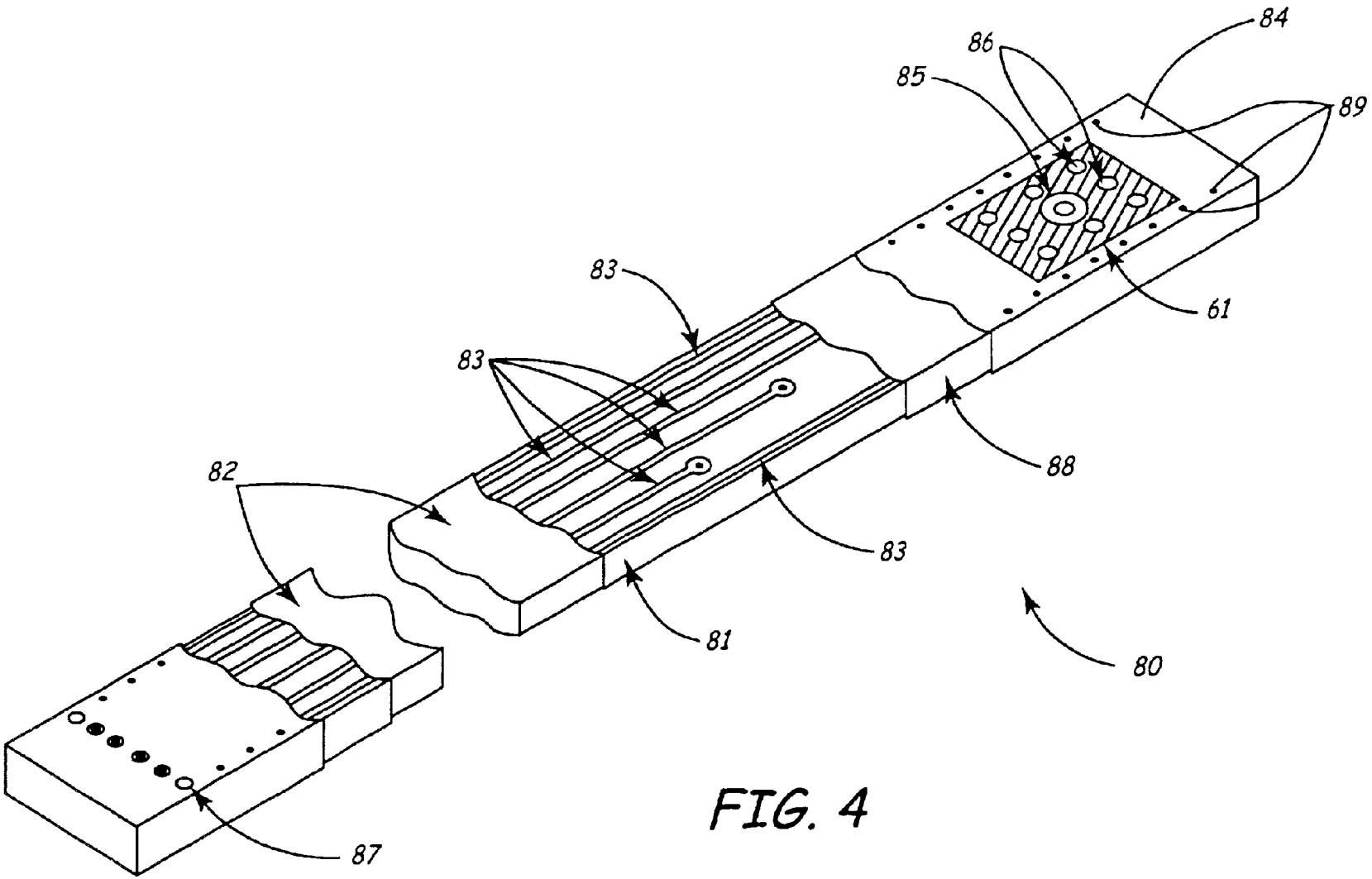
FIG. 4 is a cutaway diagram of a substrate slat with shielded circuitry on one side.

The substrate slat 80 In FIG. 4 is fabricated with a metal substrate 82 having a desired thickness and finish. In an antenna, this metal substrate 82 is maintained at ground potential. A first thin layer of dielectric 81 is applied to selected areas as needed to isolate bias/control circuit metal 83 from the metal substrate 82. A second thin layer of dielectric 88 is applied over the bias/control circuitry 83 as needed to isolate the bias/control circuit 83 metal from a shielding metal layer 84. The shielding layer 84 may be grounded to the metal substrate 82. This connection path can be accomplished in a continuous manner or through a series of closely spaced small holes 89 that are formed in the dielectric layers 81 and 88. Coatings/circuitry can be applied to one or both sides of a substrate slat 80, as required.

The location of circuit terminations 85 and 86 for electrical connection to the EMXT device 61 can be on either side of the substrate slat 80. Terminations 85 and 86 may be on the same side of the substrate 80 as the shielded bias/control circuitry 83. An opening in the shielding layer 84 may be required to reveal each electrically isolated bias pad 85. Ground connections 86 may be made directly to the shielding metal 82.

Terminations 85 and 86 may be on the side of the slat substrate 80 opposite the shielded bias/control circuitry 83. Ground connections 86 may be made directly to the substrate metal 82. Bias connections 85 require a via through the substrate 80 and electrical isolation from the substrate metal 82. Metallization of the via can be accomplished during bias/control circuit 83 formation.

Additional circuit terminations 87 may be required elsewhere on the substrate to facilitate attachment of a connector or other means for receiving bias/ground and control signals from a source external to the slat substrate 80.

There are at least two options for EMXT device 61 mechanical attachment and electrical connection. Solder bump attachment to the EMXT device 61 backside may be used to secure the device and accomplish the required ground and bias connections. Underfill of the EMXT device 61 may be used to enhance the attachment ruggedness. Wirebonds to the EMXT device 61 topside for ground 86 and bias 85 connections may be made and a bonding method such as adhesive or metallurgical bonding may be used to attach the device backside to the slat substrate 80.

The overall approach described above permits assembly of EMXT devices 61 to one face of a substrate slat 80 or possibly to both faces. If the EMXT device 61 attachment is to one face of the slat 80, then device and slat subassemblies may be placed back-to-back as discussed below without electrical interaction because the bias circuitry 83 is fully enclosed or shielded.

Methods for forming circuits can place the bias 85 and ground 86 connection pads for the EMXT device 61 on either side of the column slat 80, either on the circuit 83 side of the slat 80 or on the side of the slat 80 opposite the circuit traces 83. The decision regarding whether to attach the phase shifting devices 61 to the circuit side or to the substrate side may depend on mechanical issues surrounding the application.

From a packaging, interconnect, and construction perspective, the objective of the present invention is to create cost-effective EMXT-based phased array antennas having multiple (hundreds or thousands) active elements in an X by Y configuration. Each element is comprised of EMXT sidewalls and a conductive (metallic) floor and ceiling. Each EMXT device requires a bias voltage plus a ground connection in order to control the phase shift for each element of the antenna. By controlling phase shift performance of the elements, the beam of the antenna can be formed and steered. The maximum permitted distance between centerlines of adjacent apertures is $\lambda_o/2$ in both the X and Y directions, and the total thickness of the EMXT plus mounting structure and interconnect must be minimized.

Figure 5:
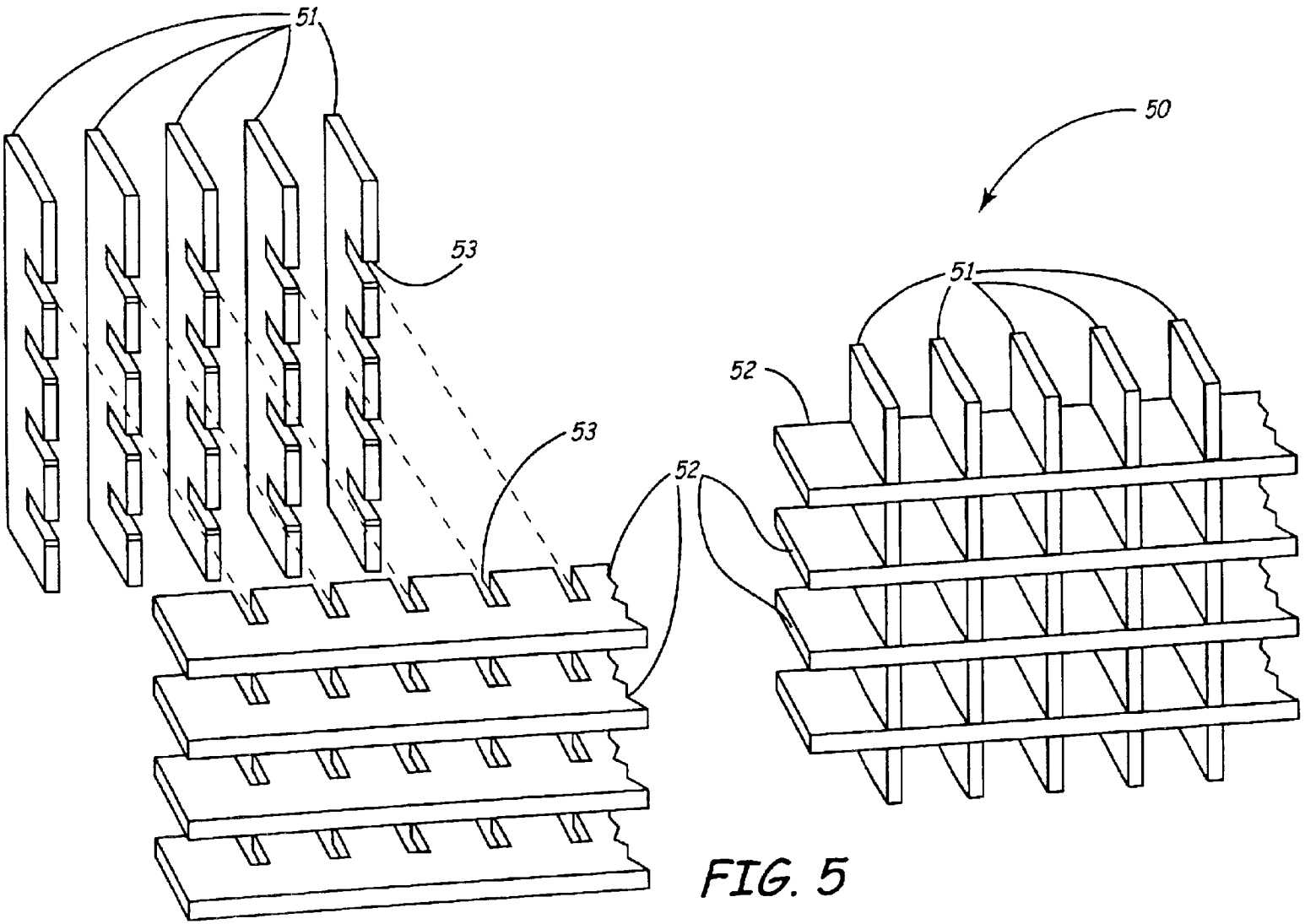
FIG. 5 is a diagram showing an array grid created by using row and column slats having interlocking slots.

The present invention creates a waveguide grid array assembly 50 using slats as shown in FIG. 5. The slat geometry ensures accurate and repeatable element size and spacing, while simultaneously providing the needed structure for the array 50. The selected approach utilizes an egg crate-like grid array assembly 50 of slotted, interlocking planar column 51 and row 52 slats as shown in FIG. 5. The slats are configured to contain notches or slots 53 in the columns 51 and rows 52 intended to engage and grip the mating parts and to ensure precise periodicity and spacing of the array elements. Accurate control of the width of the slots 53 ensures proper engagement of and position tolerance for the mating parts. Several fabrication processes, including chemical milling and etching and stamping, may provide the precision required for positioning and periodicity.

Row slats 52 form the floor and ceiling for each element of the grid array 50. The row slats 52 may be metal strips with the appropriate geometry and finish.

Figure 6:
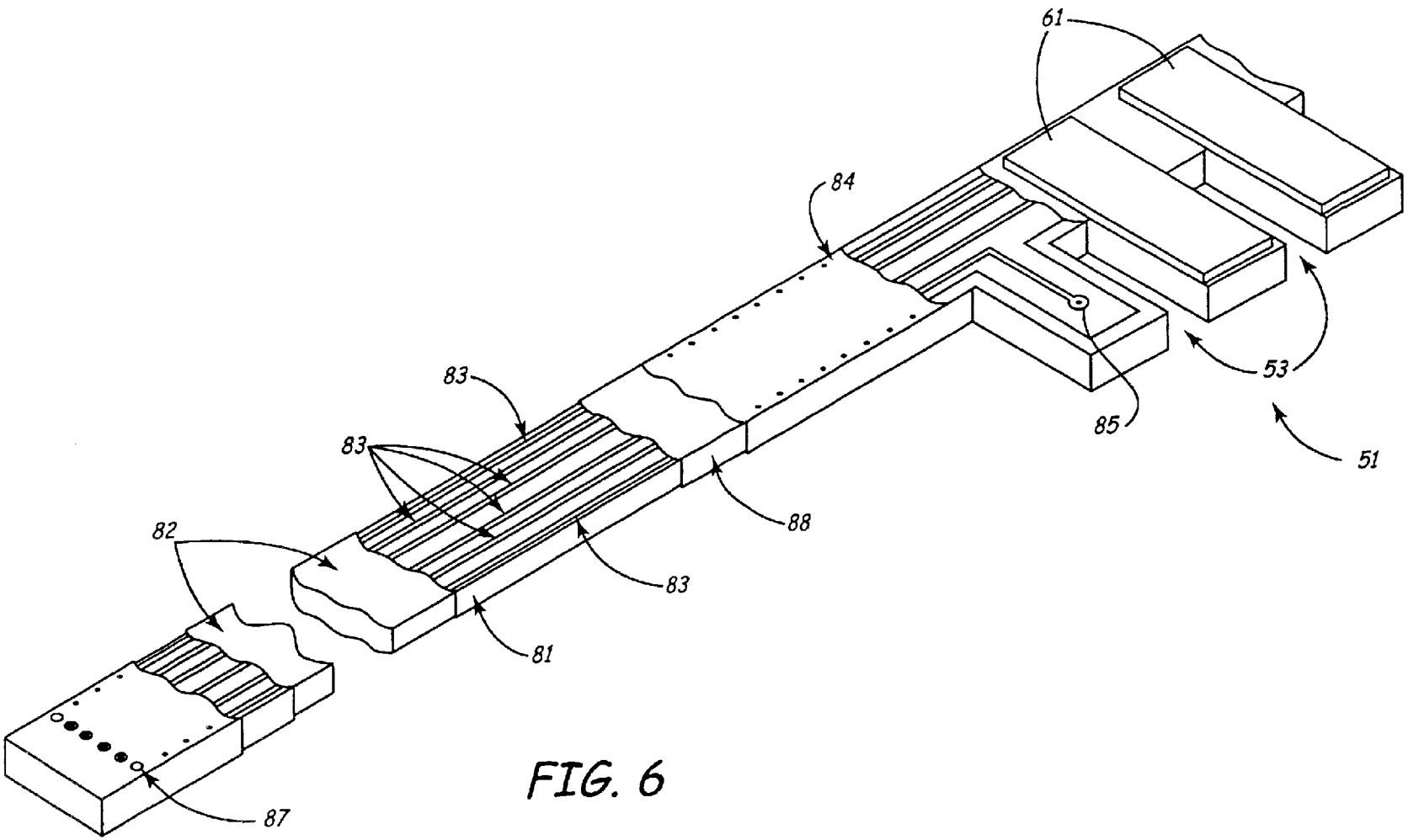
FIG. 6 is a perspective view of a column slat having shielded circuitry, attached EMXT devices, and interlocking slots.

The column slats 51 are modified planar slats 80 shown in FIG. 4. Each column slat 51 is a subassembly comprising a metal substrate 82 with a shield 84, dielectric layers 81, circuitry 83 and EMXT devices 61 attached as shown in FIG. 6 and as described above. The shape of the column slat 51 in FIG. 6 differs somewhat from that of FIG. 4 to enable the egg crate assembly 50 with slots 53 and to accommodate the specific shape of the EMXT devices 61 of this embodiment.

Figure 7:
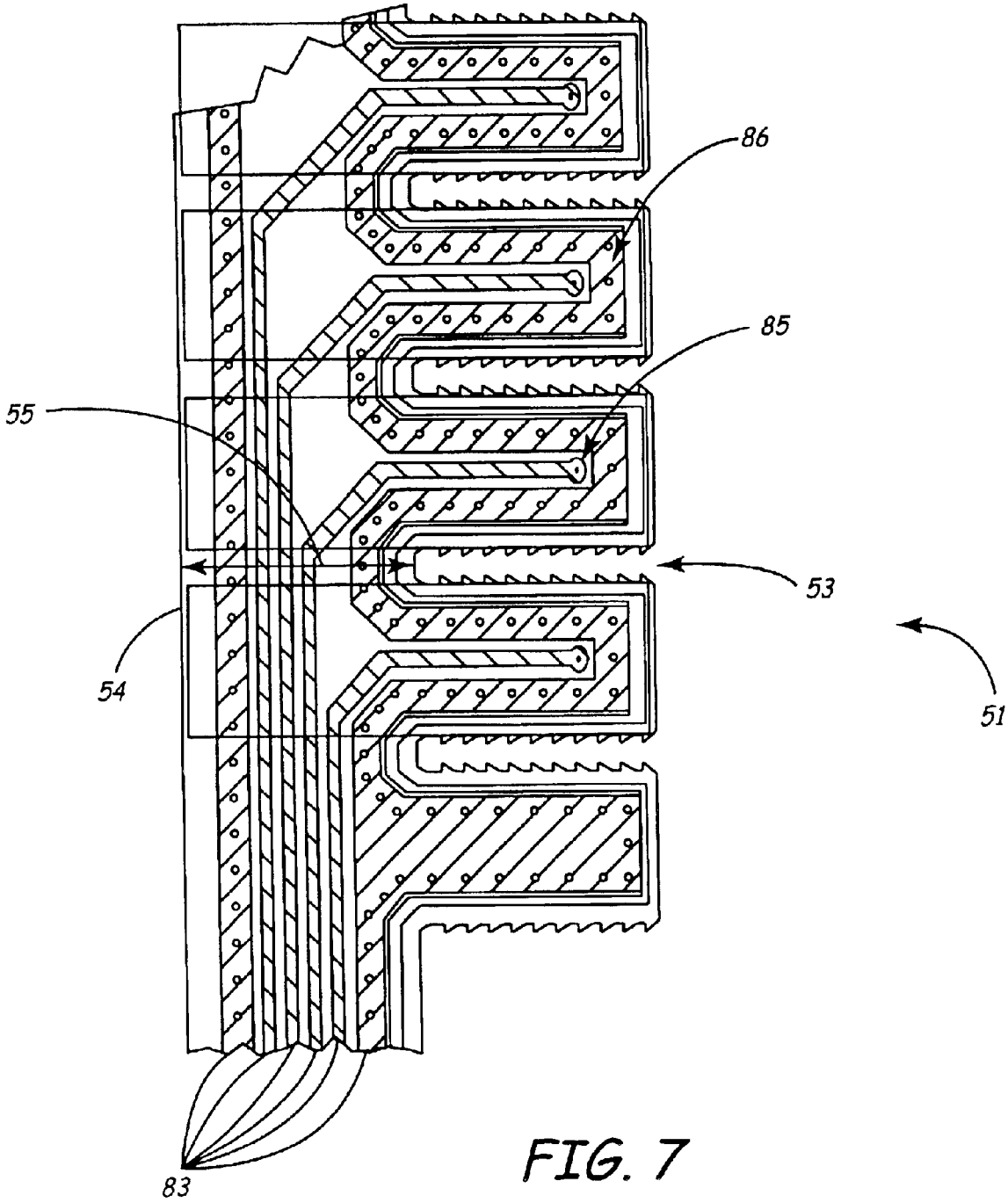
FIG. 7 is a column slat view showing space available for circuit traces.

As discussed above, there are two or more methods for EMXT device 61 mechanical attachment and electrical connection. In the present embodiment, solder bump attachment to the EMXT device 61 backside is used. This method simultaneously forms the mechanical attachment and the electrical (ground and bias) connections. For this particular embodiment, the EMXT devices 61 are processed such that their back side surface contains a number of pads and lands for connection to the appropriate mating pads 85 on the circuitized column slat 51 using small solder balls. This attachment methodology is in widespread use in the electronics industry. Bias circuit 83 routing on the column slat 51 can be accomplished as shown in FIG. 7, where all bias and ground lines 83 on any circuit layer on the substrate must fit in the space 55 from the edge of the column 54 to the base of the engagement slot 53.

Figure 8:
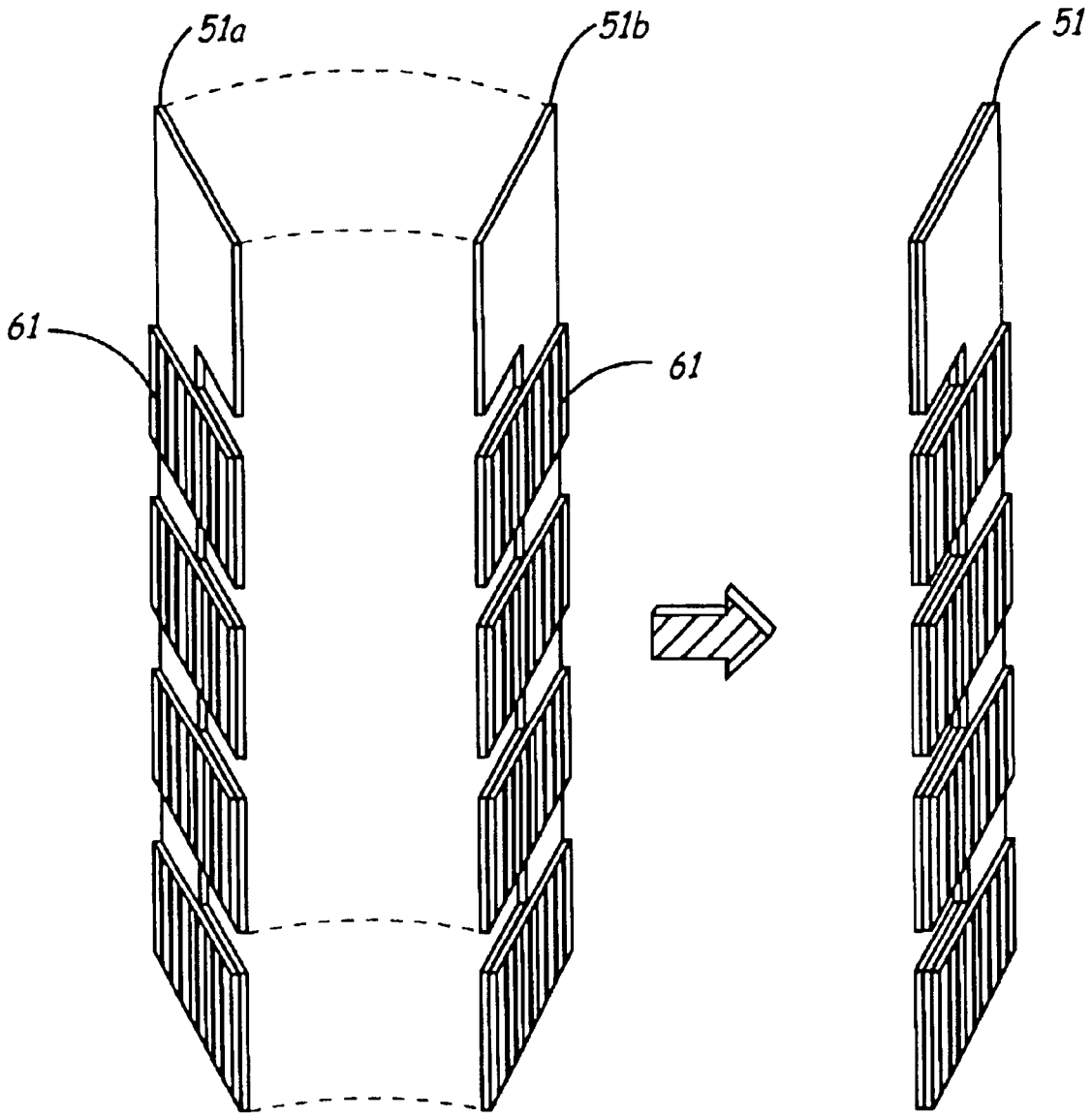
FIG. 8 is a drawing showing two mirror image column subassemblies placed back-to-back for inclusion in an egg crate array grid.
Figure 9:
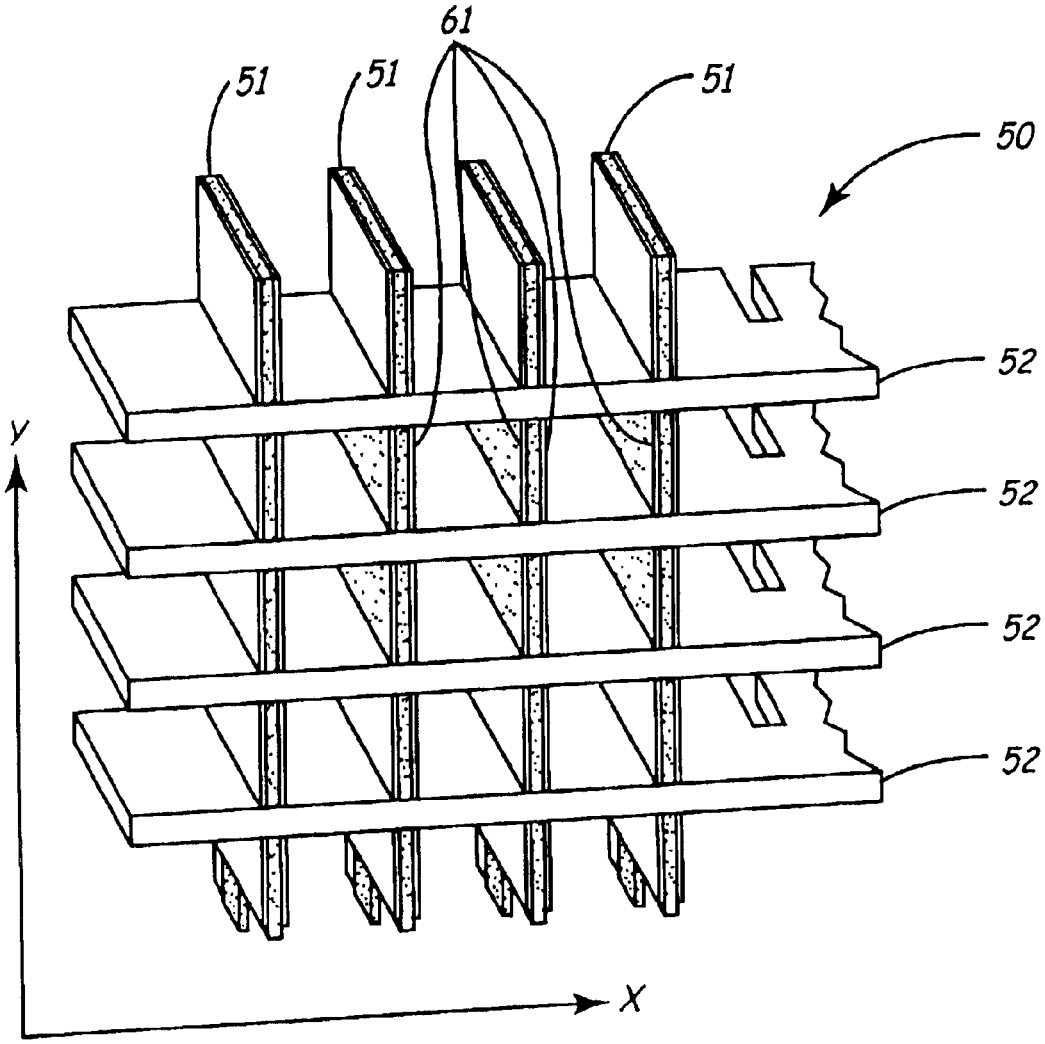
FIG. 9 is a diagram of a portion of an array grid containing back-to-back column slats.

Two column subassemblies 51*a* and 51*b* containing EMXT devices 61, where each column subassembly is a mirror image of the other as indicated in FIG. 8 may be placed back-to-back to form the single column slat 51 in the egg crate grid structure 50 while still preserving the basic construction approach, as shown in FIG. 8. Fully implementing this approach results in an array grid 50 as depicted in FIG. 9.

Traditional concerns and practice for all metallic waveguides operating in the preferred $TE_{01}$ mode require that each notch or slot of the egg crate structure 50 reliably contact the mating part to ensure frequent, near-continuous grounding of mated pairs. However, simulations and laboratory measurement indicate that small gaps are not detrimental to the performance for an EMXT-based phased array antenna. This is due to the high impedance resonant condition of the EMXT 61 sidewall, which to the first order approximates a parallel plate slab waveguide having an infinite transverse dimension. This structure has no current flow in the height dimension (Y direction in FIG. 9) of the waveguide, and therefore a discontinuity of the metallic surface at a waveguide corner is of no consequence. Two or more planar strips of material may be stacked together to act as a single row slat 52 or a single column slat 51, while still retaining the egg crate-like array structure 50.

Figures 10A, 10B:
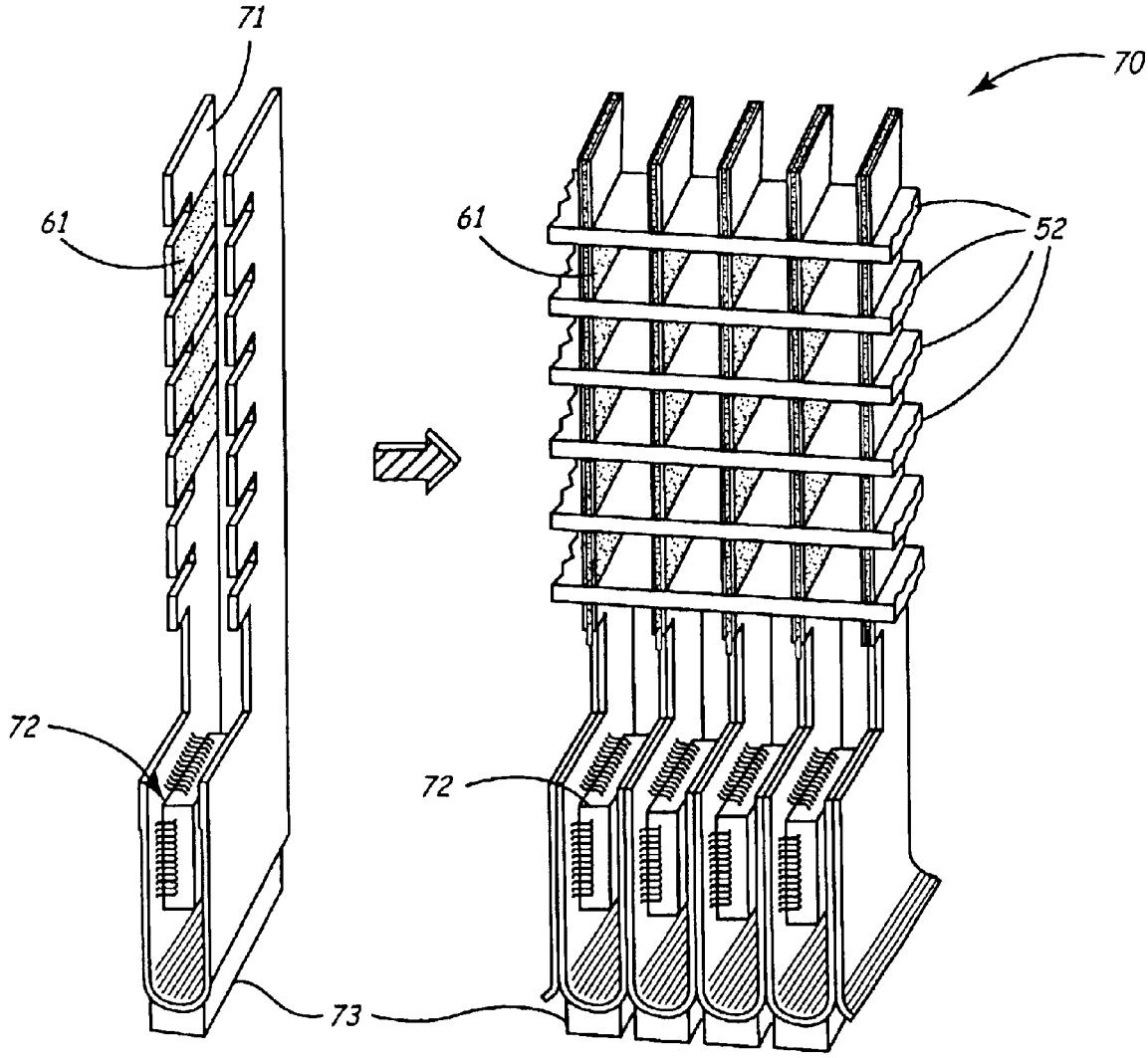
FIG. 10*a* is a drawing of a single U-shaped column subassembly.
FIG. 10*b* is a drawing of multiple U-shaped column slat assemblies combined to form a portion of an antenna array.

Further enhancements that improve the antenna construction are shown in FIGS. 10*a* and 10*b*. For the 38-GHz EMXT-based phased array antenna being used as an example, at any moment in time both of the EMXT devices 61 in a given array element typically operate at the same bias voltage. Common circuit traces may be used to connect the two EMXT devices 61, so a single bias voltage connection from a beam steering controller (not shown) serves both devices 61. It is possible, however, in some cases to have independent left and right EMXT bias within a waveguide. In order to simplify interconnection of the EMXT devices 61 a single circuitized column strip 71 configured in a U-shape such that one side of the U forms the left-hand side of each array element in that column, and the other side of the 'U' forms the opposing right-hand side of each array element. The right-hand side and the left-hand side may be mirror images of each other. This approach, depicted in FIG. 10*a,* simplifies circuit routing and minimizes the amount of interconnect required between the beam steering controller and the array grid.

Still further simplification may be achieved if selected devices such as a D/A converter 72 or other circuit elements (not shown) that are needed for operation of the antenna are mounted directly on each U-formed column subassembly 71 as shown in FIG. 10*a*. Using this approach, a limited number of digital signal lines are connected to each U-shaped column subassembly 71 to drive the D/A converter 72. The D/A converter 72 provides the required analog voltage to each bias line on the U-shaped column 71 to which it is mounted. An additional benefit is that the analog control for each EMXT 61 is as close to those devices as possible. Short analog line length improves EMI immunity and pulse distortion (leading/trailing edge pulse deterioration) due to excessive control line capacitance.

The U-shaped column assemblies 71 may then be mounted back-to-back in a fashion similar to that shown in FIG. 8 with metallic row slats 52 added to provide a complete egg crate grid array assembly 70 shown in FIG. 10*b*.

An important concept intrinsic to the egg crate design approach is that the geometry of row 52 and/or column slats 51 may be configured as needed in the areas beyond the radiating element boundary. This design freedom may be used to accommodate items such as extra devices (e.g., the D/A converter 72 in FIG. 10*a*) to facilitate mounting of the elements or to enable the electromagnetic radiation to be contained.

For the 38-GHz example antenna, the length of the EMXT device 61 is 10 mm (~0.4") and the widest portion of the column slat under the EMXT device 61 shown in FIG. 6 is approximately that same dimension. These dimensions apply in areas where the EMXT devices 61 are mounted, whether the column subassembly is a single, straight column slat 51 or the U-shaped column slat 71. A typical commercially available D/A device 72 for this application would likely be approximately 0.5" square, which would require the column slat 71 to be somewhat wider than 10 mm in the area where the component is mounted. Additional width might also be required for the needed circuit traces associated with the D/A 72 input/output. A connector 73 may be mounted at the apex of the U-bend to interconnect the column subassembly 71 to the beam steering controller and other necessary signals. This connector 73 may also require additional column slat width. As shown in FIG. 10*a,* the U-shaped column slat 71 is wider in the area where the connector 73 and D/A converter 72 are mounted than the area where the EMXT devices 61 are mounted in the array element.

The egg crate array 70 of FIG. 10*b* needs to be mounted in some manner to fix its position relative to a feed and to protect the array 70 from its application environment (e.g., condensing moisture, etc). Having the freedom to tailor the shape and form of the row 52 and column slats 71 facilitates such mounting.

Figure 11:
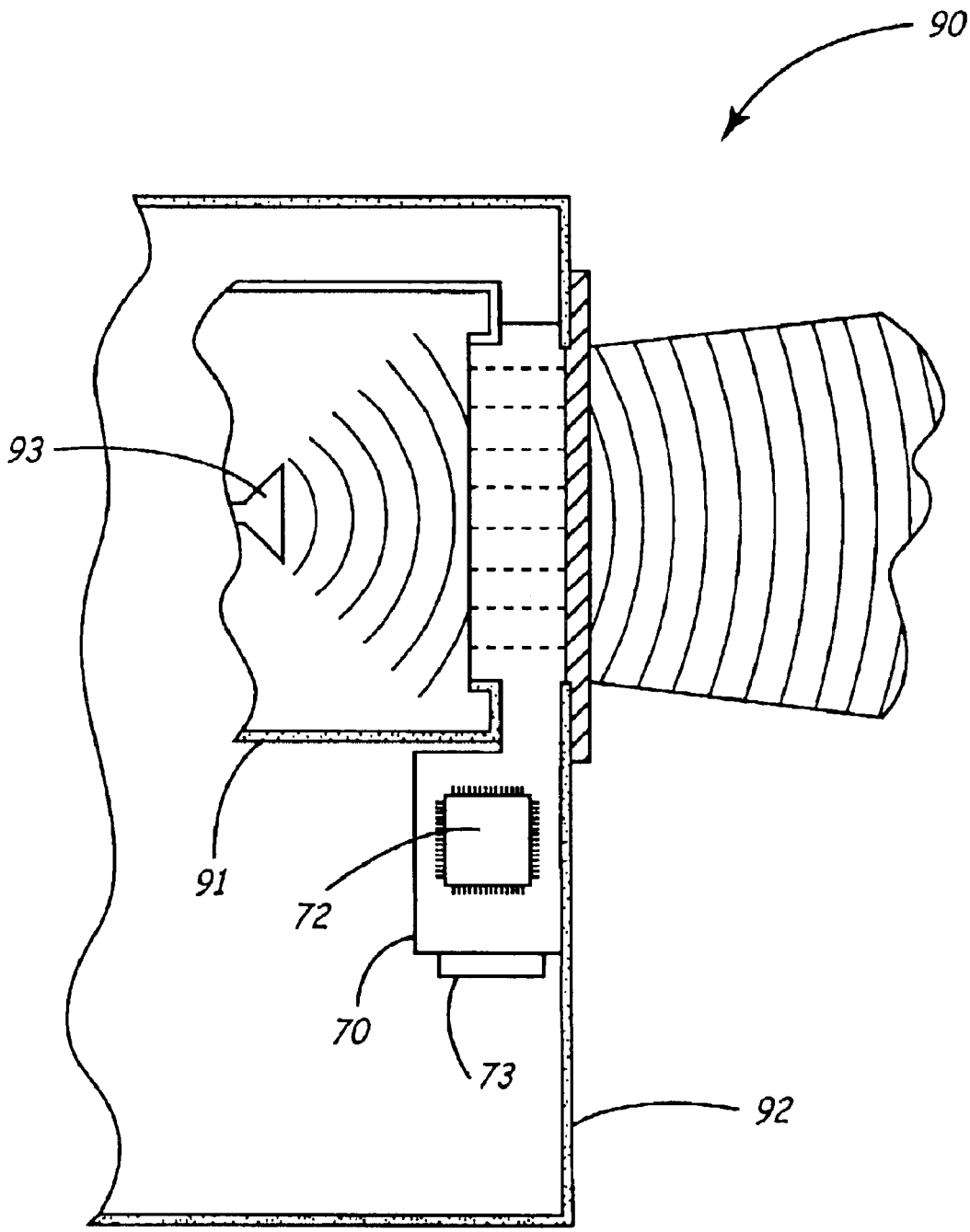
FIG. 11 is a cross section sketch of a packaged antenna with a space feed arrangement.

It is important that electromagnetic radiation be contained so it does not interfere with other electronic functions such as the beam steering controller or other circuitry. The row 52 and column slats 71 that comprise the egg crate array assembly 70 can be configured to facilitate this isolation. One possible approach is shown in FIG. 11. Other feed approaches are possible as previously discussed.

FIG. 11 shows a packaged phased array antenna 90 depicted in cross section. A small enclosure 91 is located inside a larger enclosure 92. A small enclosure 91 spatially positions the array 70 of FIG. 10*b* and a feed 93 relative to each other. Both the array 70 and the feed 93 are rigidly secured and sealed to the small enclosure 91. About half of the array 70 thickness penetrates into the small enclosure 91, facilitating the positioning, the securing, and the sealing that is required. Also note that the U-shaped column slat array 70 can extend considerably beyond the limits of the small enclosure's 91 dimensions as may be required for accommodation of the D/A converter 72 or other devices, the connector 73, or a connection to the beam steering controller (not shown), etc.

The mounting is designed so a larger enclosure 92 is sealed against or around the outer face of the array 70. In this manner, all of the enclosed space between the two enclosures will be free from any electromagnetic radiation that is intended to travel through the grid array 70. The space between the two enclosures may safely be used for circuitry related to the beam steering controller, I/O, power supply, etc.

The construction approach discussed herein enables an array having almost any practical number of radiating elements. Array width is determined by the number of column assemblies that are used. A large array height may be accommodated by implementing column subassemblies having multiple layers of circuitry to accommodate the large number of bias lines required to address all the EMXT devices on such a column subassembly. Extremely large arrays may be assembled by means of a modular or tiled sub-array approach. Space-saving approaches need to be utilized to mechanically and electrically interlock adjacent sub-arrays to each other as they are tiled together or route the needed bias/control interconnect from the antenna periphery inward to each sub-array. Also, some kind of framework/structure may be needed to achieve the necessary mechanical integrity while enabling routing of control circuitry.

The waveguide array embodiment discussed herein is configured for vertical polarization but can be appropriate for horizontal polarization by rotating 90 degrees about an axis that is normal to the X-Y plane of the array 50 in FIG. 9. Circular polarization can be realized by using a polarizer.

The use of a specific embodiment in this disclosure is intended to facilitate description of the invention. This specific discussion can be generalized to extend the egg crate approach to realize antenna designs across a wide range of operating frequencies, electrical size, EMXT types, physical shapes, etc.

It is believed that the construction approach for a phased array antenna of the present invention and many of its attendant advantages will be understood by the foregoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. An EMXT-based phased array antenna for steering a radiated beam and having an egg crate-like array structure of a plurality of array elements said antenna comprising:

a plurality of row slats formed from a substrate having a plurality of row slots;

a plurality of column slats having a plurality of column slots said column slots engaging said row slots of said row slats to form the egg crate-like array structure said column slats further comprising column strips configured in a U-shape such that a left side of the U-shape forms a left-hand side of each array element in a column and a right side of the U forms an opposing right-hand side of each array element in said column said column strips mounted back-to-back with adjacent column strips to form the column slats.

2. The EMXT-based phased array antenna of claim 1 wherein each of said U-shaped column strips comprises:

a metal substrate for supporting the U-shaped column strip;

a first dielectric layer applied to the metal substrate in selected areas;

metal bias/control circuitry applied to the selected areas on the first dielectric layer;

a second dielectric layer applied over the bias/control circuitry;

a shielding metal layer applied over the second dielectric layer;

circuit terminations connected to the metal bias/control circuitry for control signals and bias voltages and to the shielding metal layer for a ground connection;

a plurality of EMXT devices attached to the substrate and connected to the circuit terminations and for phase shifting and beam steering the radiated beam of the phased array antenna; and additional circuit terminations connected to the metal bias/control circuitry and the shielding metal layer for receiving supply voltages and phase shifter control signals.

3. The EMXT-based phased array antenna of claim 2 wherein the EMXT devices mounted to the column strips form left and right sidewalls of each array element.

4. The EMXT-based phased array antenna of claim 1 further comprising circuit devices for steering of the phased array antenna mounted to the U-shaped column strip.

5. The EMXT-based phased array antenna of claim 1 further comprising a connector mounted at an apex of the U-shaped column slat.

6. The EMXT-based phased array antenna of claim 1 wherein the column strip left-hand side is a mirror image of the right-hand side.

7. The EMXT-based phased array antenna of claim 1 wherein the plurality of row slats comprise a plurality of metal strips to form a floor and ceiling of each array element.

8. A phased array antenna for steering a radiated beam and having an egg crate-like array structure of a plurality of array elements said antenna comprising:

a plurality of row slats formed from a substrate having a plurality of row slots;

a plurality of column slats having a plurality of column slots said column slots engaging said row slots of said row slats to form the egg crate-like array structure said column slats further comprising a plurality of column strips each column strip being configured in a U-shape.

9. The phased array antenna of claim 8 wherein each column strip is configured such that a left side of the U-shape forms a left-hand side of each array element in a column and a right side of the U forms an opposing right-hand side of each array element in said column said column strip sides mounted back-to-back with sides of adjacent column strips to form the column slats.

10. The phased array antenna of claim 9 wherein the column strip left-hand side is a mirror image of the right-hand side.

11. The phased array antenna of claim 8 wherein the U-shape column strip further comprises:

interconnect circuitry; and a plurality of EMXT devices mounted on the U-shape column strip and connected to the interconnect circuitry for phase shifting to steer the radiated beam of the EMXT-based phased array antenna.

12. The phased array antenna of claim 11 wherein the EMXT devices mounted to the column strip form left and right sidewalls of each array element.

13. The EMXT-based phased array antenna of claim 11 further comprising circuit devices for steering of the phased array antenna mounted to the U-shaped column strip.

14. The EMXT-based phased array antenna of claim 11 further comprising a connector mounted at an apex of the U-shaped column slat.

15. The phased array antenna of claim 8 wherein each of said U-shaped column strips comprises:

a metal substrate for supporting the U-shaped column strip;

a first dielectric layer applied to the metal substrate in selected areas;

metal bias/control circuitry applied to the selected areas on the first dielectric layer;

a second dielectric layer applied over the bias/control circuitry;

a shielding metal layer applied over the second dielectric layer;

circuit terminations connected to the metal bias/control circuitry for control signals and bias voltages and to the shielding metal layer for a ground connection;

a plurality of EMXT devices attached to the substrate and connected to the circuit terminations and for phase shifting and beam steering a radiated beam of the phased array antenna; and additional circuit terminations connected to the metal bias/control circuitry and the shielding metal layer for receiving supply voltages and phase shifter control signals.

16. The phased array antenna of claim 8 wherein the plurality of row slats comprise a plurality of metal strips to form a floor and ceiling of each array element.

17. A phased array antenna having an egg crate structure of a plurality of array elements said antenna comprising:

a plurality row slats formed from a metallic substrate having a plurality of row slots said row slats forming a floor and ceiling of each of said array elements; and a plurality of column slats having a plurality of column slots said column slots engaging said row slots of said row slats to form the egg crate array structure said column slats further comprising a plurality of EMXT devices located on the column slats such that a pair of EMXT devices form walls of each of said array elements and wherein said column slats further comprise a plurality of column strips each column strip being configured in a U-shape.

18. The phased array antenna of claim 17 wherein each column strip is configured such that a left side of the U-shape forms a left-hand side of each array element in a column and a right side of the U forms an opposing right-hand side of each array element in said column said column strips sides mounted back-to-back with sides of adjacent column strips to form the column slat.

19. The phased array antenna of claim 18 further comprising circuit devices for operation of the antenna mounted to the U-shaped column strip and a connector mounted at an apex of the U-shaped column slat.

* * * * *